US009666973B1

(12) United States Patent
Strahl

(10) Patent No.: US 9,666,973 B1
(45) Date of Patent: May 30, 2017

(54) SELF-LOCKING CONNECTOR COUPLING

(71) Applicant: Amphenol Corporation, Wallingford, CT (US)

(72) Inventor: Erik Strahl, Unadila, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/178,868

(22) Filed: Jun. 10, 2016

(51) Int. Cl.
*H01R 13/622* (2006.01)
*H01R 13/512* (2006.01)

(52) U.S. Cl.
CPC ..... *H01R 13/512* (2013.01); *H01R 13/622* (2013.01)

(58) Field of Classification Search
CPC ..... H01R 13/622
See application file for complete search history.

(56) References Cited

U.S. PATENT DOCUMENTS 1,076,674 A * 10/1913 Jacobs ..... F16B 39/32 411/299
1,140,167 A 5/1915 Kolb et al.
2,728,895 A 12/1955 Quackenbush et al.
3,594,700 A * 7/1971 Nava ..... H01R 13/621 285/81
3,601,764 A * 8/1971 Cameron ..... H01R 13/621 285/88
3,723,940 A 3/1973 Leonard
3,733,575 A 5/1973 Gottschalk et al.
3,869,186 A * 3/1975 Vetter ..... H01R 13/621 285/82
3,892,458 A * 7/1975 Clark ..... H01R 13/623 439/319
3,917,373 A * 11/1975 Peterson ..... H01R 13/621 285/82
4,030,798 A * 6/1977 Paoli ..... H01R 13/621 285/85
4,066,315 A * 1/1978 Arneson ..... H01R 13/622 439/311
4,109,990 A * 8/1978 Waldron ..... H01R 13/622 411/315
4,152,039 A * 5/1979 Shah ..... H01R 13/622 285/81
4,165,910 A * 8/1979 Anderson ..... H01R 13/625 439/318

(Continued)

*Primary Examiner* — Ross Gushi
(74) *Attorney, Agent, or Firm* — Blank Rome LLP; Tara L. Marcus

(57) ABSTRACT

A connector coupling that has a body, an inner sleeve receiving the body, at least one self-locking pawl pivotably coupled to the inner sleeve that is configured to toggle between first and second positions in engagement with ratchet teeth of the body, and an outer sleeve surrounding the inner sleeve. The inner and outer sleeves are rotatable together in opposite mating and unmating directions. At least one spring member is attached to the outer sleeve and is configured to bias the pawl. When the pawl is in the first position engaging the ratchet teeth, the inner and outer sleeves are rotatable together in the mating direction only and prevented from rotating in the unmating direction and when the pawl is in the second position engaging the ratchet teeth, the inner and outer sleeves are rotatable together in the unmating direction only and prevented from rotating in the mating direction.

21 Claims, 3 Drawing Sheets

(56) References Cited

U.S. PATENT DOCUMENTS 4,183,605 A * 1/1980 Arneson ..... H01R 13/622 439/311
4,208,082 A 6/1980 Davies et al.
4,239,314 A * 12/1980 Anderson ..... H01R 13/622 285/82
4,257,663 A * 3/1981 Brush ..... H01R 13/622 411/298
4,268,103 A * 5/1981 Schildkraut ..... H01R 13/622 285/88
4,272,144 A * 6/1981 Brush ..... H01R 13/622 439/321
4,291,933 A * 9/1981 Kakaris ..... H01R 13/622 439/321
4,457,469 A * 7/1984 Ratchford ..... H01R 13/622 439/312
4,462,652 A * 7/1984 Werth ..... H01R 13/622 439/312
4,462,657 A 7/1984 Snowdon et al.
4,468,077 A * 8/1984 Brush, Sr. ..... H01R 13/622 439/312
4,472,013 A * 9/1984 Frear ..... H01R 13/622 439/312
4,484,790 A * 11/1984 Schildkraut ..... H01R 13/622 439/312
4,487,470 A * 12/1984 Knapp ..... H01R 13/622 439/312
4,497,530 A * 2/1985 Shannon ..... H01R 13/622 439/312
4,502,748 A * 3/1985 Brush, Sr. ..... H01R 13/622 439/313
4,508,406 A * 4/1985 Brush, Sr. ..... H01R 13/622 439/312
4,519,661 A * 5/1985 Brush, Sr. ..... H01R 13/622 439/312
4,531,801 A * 7/1985 Baur ..... H01R 13/639 439/313
4,536,048 A * 8/1985 Schildkraut ..... H01R 13/622 439/312
4,548,458 A * 10/1985 Gallusser ..... H01R 13/622 439/312
4,648,670 A * 3/1987 Punako ..... H01R 13/622 285/319
4,703,988 A * 11/1987 Raux ..... H01R 13/622 439/321
4,726,782 A * 2/1988 Hager ..... H01R 13/622 439/321
4,741,706 A * 5/1988 Takeda ..... H01R 13/623 439/318
4,746,303 A * 5/1988 Cobraiville ..... H01R 13/622 439/321
4,793,821 A * 12/1988 Fowler ..... H01R 13/639 439/321
4,808,117 A * 2/1989 Gale ..... F16L 25/01 439/192
4,820,184 A * 4/1989 Brandes ..... H01R 13/639 29/469
4,834,667 A * 5/1989 Fowler ..... H01R 13/639 285/92
4,878,862 A 11/1989 Wise
4,928,202 A * 5/1990 Gale ..... F16L 19/005 174/47
4,981,449 A 1/1991 Buchter
4,983,132 A 1/1991 Weidler
5,082,454 A * 1/1992 Tonkiss ..... H01R 13/622 439/312
5,145,394 A * 9/1992 Hager ..... H01R 13/622 285/92
5,192,219 A 3/1993 Fowler et al.
5,399,096 A * 3/1995 Quillet ..... H01R 13/622 439/312
5,435,760 A 7/1995 Miklos
5,496,189 A * 3/1996 Over ..... H01R 13/622 439/321
5,590,228 A 12/1996 Gibola et al.
5,653,605 A * 8/1997 Woehl ..... H01R 13/622 439/321
5,702,263 A * 12/1997 Baumann ..... H01R 13/622 439/321
5,786,976 A * 7/1998 Field ..... F16L 25/01 361/215
5,897,277 A * 4/1999 Barre ..... F01D 21/003 411/120
5,957,716 A 9/1999 Buckley et al.
6,086,400 A 7/2000 Fowler
6,123,563 A * 9/2000 Johnson ..... H01R 13/622 439/321
6,152,753 A * 11/2000 Johnson ..... H01R 13/622 439/312
6,293,595 B1 9/2001 Marc et al.
6,527,575 B2 * 3/2003 Scholler ..... H01R 13/622 439/320
7,252,536 B2 8/2007 Lazaro, Jr. et al.
7,587,244 B2 * 9/2009 Olbertz ..... A61N 1/3752 607/37
7,625,226 B1 * 12/2009 Gastineau ..... H01R 13/622 439/321
7,704,083 B1 4/2010 Cheyne et al.
7,845,963 B2 * 12/2010 Gastineau ..... H01R 13/622 439/321
7,905,741 B1 * 3/2011 Wade ..... H01R 13/622 439/321
7,914,311 B1 * 3/2011 Gallusser ..... H01R 13/639 439/321
8,025,536 B1 * 9/2011 Kelly ..... H01R 13/6456 439/681
8,550,742 B2 * 10/2013 Leroyer ..... H01R 13/623 403/342
8,579,644 B2 * 11/2013 Cole ..... H01R 13/533 439/312
8,960,726 B2 * 2/2015 Nick ..... F16L 19/005 285/84
9,099,807 B2 * 8/2015 Opgenorth ..... H01R 13/622
9,106,012 B2 * 8/2015 Gross, III ..... H01R 13/622
9,217,524 B2 * 12/2015 Nick ..... F16L 19/005
9,362,666 B2 * 6/2016 Laughlin ..... H01R 13/629
9,397,441 B2 * 7/2016 Sun ..... H01R 13/622
2006/0079109 A1 * 4/2006 Castleman ..... H01R 13/622 439/312
2008/0012330 A1 * 1/2008 Leroyer ..... H01R 13/622 285/386
2009/0297256 A1 * 12/2009 Gross, III ..... H01R 13/622 403/105
2016/0020552 A1 1/2016 Strahl

* cited by examiner

SELF-LOCKING CONNECTOR COUPLING

FIELD OF THE INVENTION

The present application relates to an anti-vibration coupling for an electrical connector that prevents loosening of the electrical connector due to conditions, such as vibration. More specifically, the anti-vibration coupling self-locks to prevent loosening of the coupling in either the mating or unmating positions.

BACKGROUND OF THE INVENTION

Electrical connector assemblies generally include mating plug and receptacle connectors. Often a threaded nut or collar is used to mate the plug and receptacle connectors. When an electrical connector assembly is subject to vibration or shock, however, the mating connectors of the assembly often become loose or even decouple. The loosening or decoupling usually occurs because the coupling nut counter rotates, that is it rotates in a direction opposite the mating or locking direction, thereby compromising the integrity of both the mechanical and electrical connection between the plug and receptacle connectors.

Examples of some prior art couplings for electrical connector assemblies include U.S. Pat. No. 8,579,644 to Cole et al.; U.S. Pat. No. 7,914,311 to Gallusser et al.; U.S. Pat. No. 7,905,741 to Wade et al., U.S. Pat. No. 6,293,595 to Marc et al.; U.S. Pat. No. 6,123,563; U.S. Pat. No. 6,086,400 to Fowler; U.S. Pat. No. 5,957,716 to Buckley et al.; U.S. Pat. No. 5,435,760 to Miklos; U.S. Pat. No. 5,399,096 to Quillet et al.; U.S. Pat. No. 4,208,082 to Davies et al.; U.S. Pat. No. 3,917,373 to Peterson; and U.S. Pat. No. 2,728,895 to Quackenbush, the subject matter of each of which is hereby incorporated by reference. Such prior art couplings, however, are costly to manufacture, require complex precision molded parts, and have multiple moving parts. Also, existing locking connector couplings often exceed the standard dimensional envelop of typical electrical connectors, particularly circular electrical connectors.

Therefore, a need exists for an anti-vibration coupling that self-locks to prevent loosening of the mated plug and receptacle and that has a reduced number of parts, is cheaply manufactured, and sized to reside within the typical dimensional envelop of electrical connectors, particularly circular connectors.

SUMMARY OF THE INVENTION

Accordingly, an exemplary embodiment of the present invention provides a connector coupling that includes a connector body that has ratchet teeth and defines a longitudinal axis, an inner sleeve receives the connector body, at least one self-locking pawl is pivotably coupled to the inner sleeve and is configured to toggle between first and second positions in engagement with the ratchet teeth of said connector body. An outer sleeve surrounds the inner sleeve and the inner and outer sleeves are rotatable together in opposite mating and unmating directions with respect to the longitudinal axis of the connector body. At least one spring member is attached to an inner surface of the outer sleeve that is configured to bias the at least one self-locking pawl. When the at least one self-locking pawl is in the first position engaging the ratchet teeth, the inner and outer sleeves are rotatable together in the mating direction only and prevented from rotating in the unmating direction and when the at least one self-locking pawl is in the second position engaging the ratchet teeth, the inner and outer sleeves are rotatable together in the unmating direction only and prevented from rotating in the mating direction.

The present invention may also provide a connector coupling that includes a connector body that has ratchet teeth and defines a longitudinal axis, an inner sleeve receives the connector body, and at least one self-locking pawl that has opposite first and second ends and an apex portion therebetween. The apex portion has a pivot pin coupled to the inner sleeve allowing the at least one self-locking pawl to toggle between a first position, in which the first end engages the ratchet teeth, and a second position, in which the second end engages the ratchet teeth. An outer sleeve surrounds the inner sleeve. The inner and outer sleeves are rotatable together in opposite mating and unmating directions with respect to the longitudinal axis of the connector body. At least one spring member is attached to an inner surface of the outer sleeve and has first and second spring arms configured to bias the at least one self-locking pawl. When the at least one self-locking pawl is in the first position, the first spring arm contacts the first end of the at least one self-locking pawl to bias the at least one self-locking pawl in the first position and the inner and outer sleeves are rotatable together in the mating direction only and prevented from rotating in the unmating direction. When the at least one self-locking pawl is in the second position, the second spring arm contacts the second end of the at least one self-locking pawl to bias the at least one self-locking pawl in the second position and the inner and outer sleeves are rotatable together in the unmating direction only and prevented from rotating in the mating direction.

The present invention may yet further provide a method of coupling a connector coupling to a mating connector, the connector coupling having a connector body received in an inner sleeve and an outer sleeve surrounding the inner sleeve, comprising the steps of rotating the outer and inner sleeves together in a mating direction with respect to a longitudinal axis of the connector body and engaging at least one self-locking pawl coupled to the inner sleeve with ratchet teeth of the connector body in a first position preventing rotation of the inner and outer sleeves in an unmating direction opposite the mating direction; engaging threads of the inner sleeve with a mating connector; releasing the at least one self-locking pawl from engagement with the ratchet teeth in the first position by rotating the outer sleeve with respect to the inner sleeve for a controlled distance; and rotating the outer and inner sleeves together in the unmating direction and engaging the at least one self-locking pawl with the ratchet teeth in a second position preventing rotation of the inner and outer sleeves in the mating direction.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
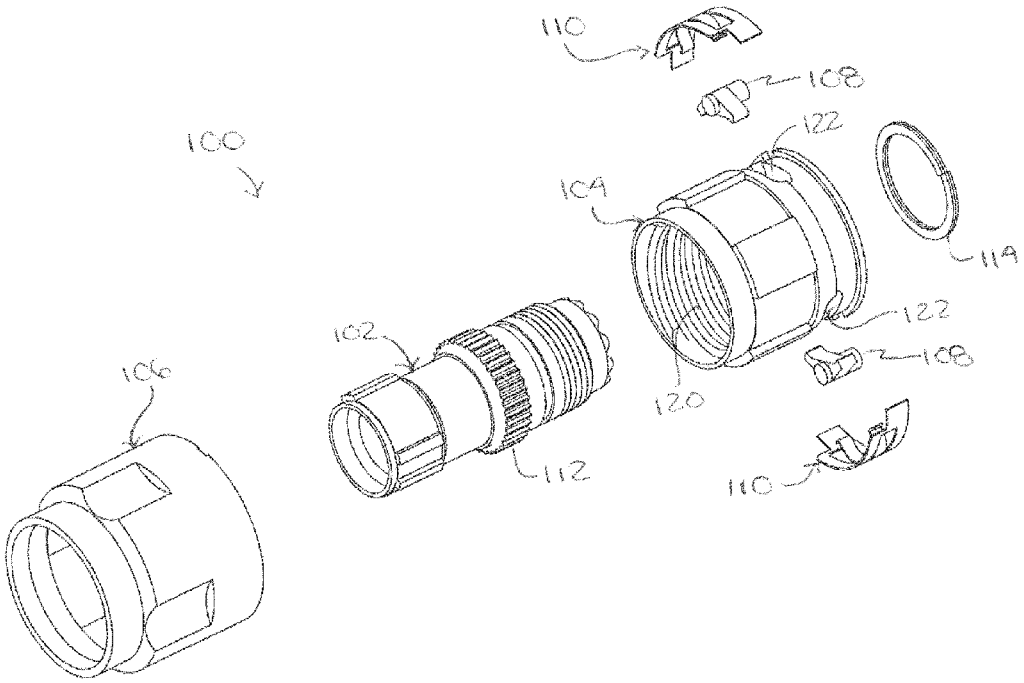
FIG. 1 is an exploded view of a connector coupling in accordance with an exemplary embodiment of the present invention.

Referring to FIGS. 1-7, the present invention relates to a connector coupling 100 for electrical connectors, such as circular electrical connectors. The coupling 100 is designed to self-lock in both mating and unmating directions to prevent loosening of the coupling when mated with another connector and to prevent separation of (and potential loss of) components of the coupling, particularly when subject to extraordinary conditions, such as vibration. The coupling 100 generally includes a connector body 102, an inner sleeve 104 that receives the connector body 102, an outer sleeve 106 that surrounds inner sleeve 104, one or more toggling pawls 108 providing self-locking to the coupling 100, and one or more spring members 110 corresponding to and biasing the one or more pawls 108.

Figure 2:
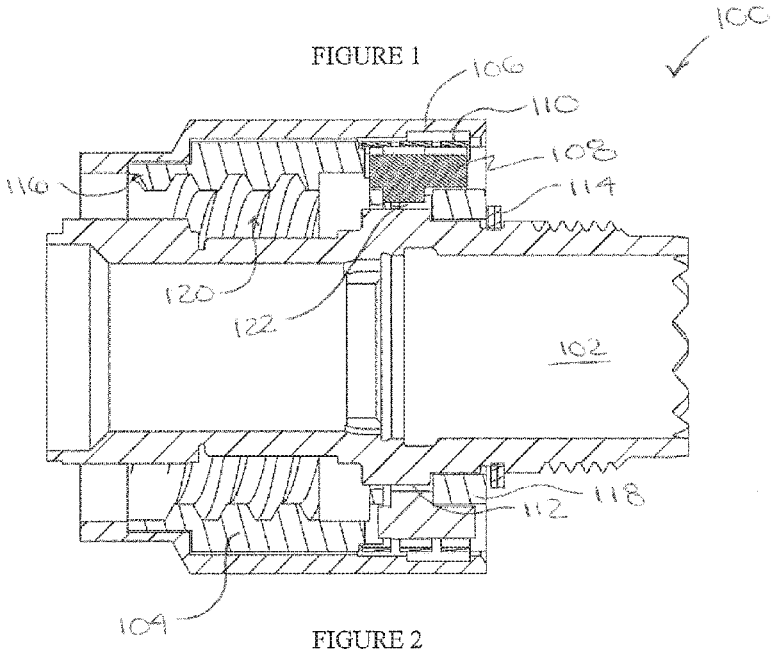
FIG. 2 is a cross-sectional view of the connector coupling illustrated in FIG. 1, taken along the longitudinal axis of the connector coupling.

Connector body 102 interfaces with a mating connector (not shown) and includes a plurality of ratchet teeth 112 for engaging the one or more pawls 108. The ratchet teeth 112 preferably form a continuous annular ring around the body 102, as best seen in FIG. 1. Inner sleeve 104 receives connector body 102, as seen in FIG. 2, which is retained therein by retaining ring 114. Inner sleeve 104 may include a front interface end 116, an opposite rear end 118, and internal threads 120 therebetween for engaging the mating connector. Proximal the rear end 118 of inner sleeve 104 are one or more cavities 122 each sized to receive one of the pawls 108 such that the pawl therein may toggle freely. Connected to each cavity 122 is a cutout 124 formed in the inner sleeve's rear end 118 for accommodating a portion of the pawl received in the cavity.

Figure 4:
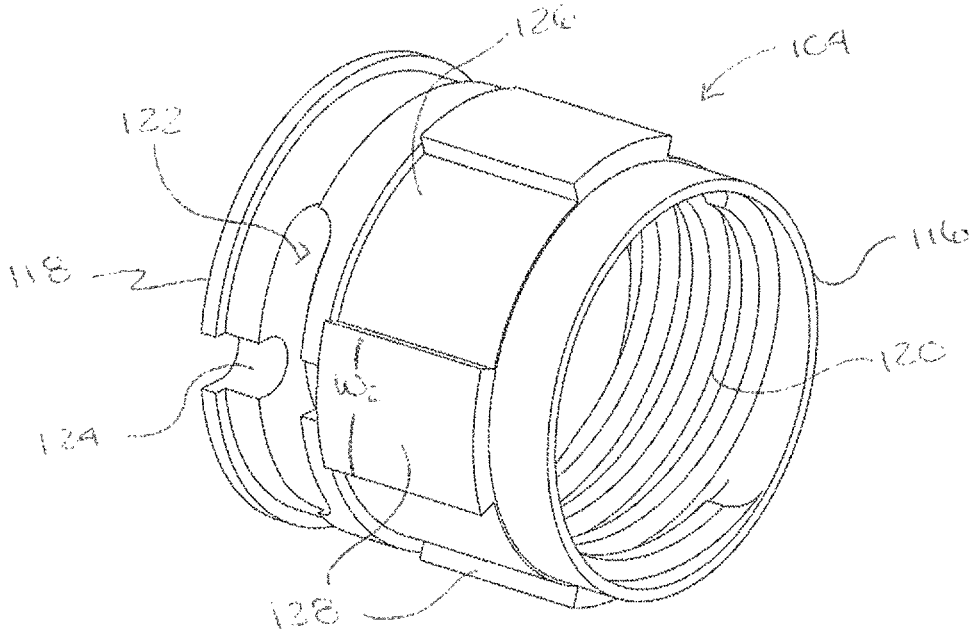
FIG. 4 is a perspective view of an inner sleeve of the connector coupling illustrated in FIG. 1.
Figure 5:
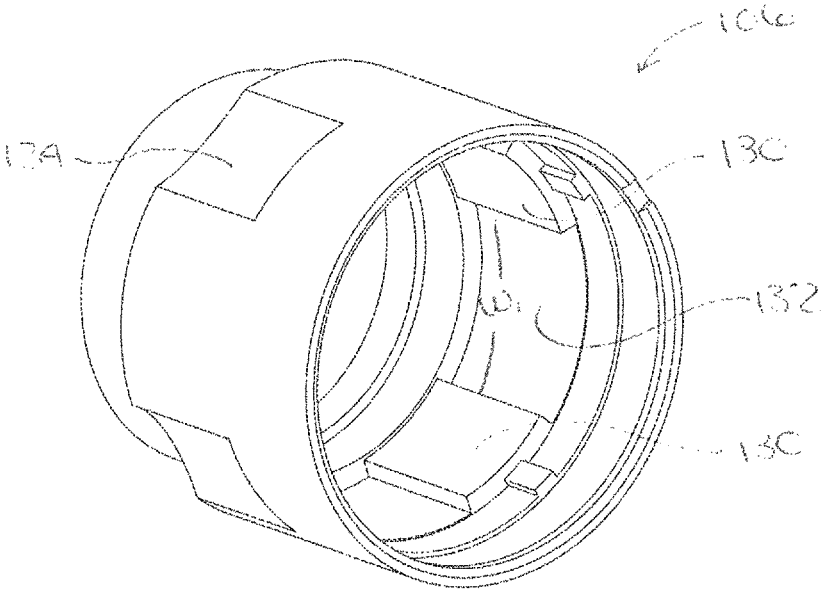
FIG. 5 is a perspective view of an outer sleeve of the connector coupling illustrated in FIG. 1.

An outer surface 126 of inner sleeve 104 preferably engages with outer sleeve 106. In particular, outer surface 126 may include one or more alignment members 128 that engage corresponding alignment members 130 of outer sleeve 106. As seen in FIGS. 4 and 5, the one or more alignment members 128 of inner sleeve 104 may be, for example, a key or keys extending from outer surface 126, and the one or more alignment members 130 of outer sleeve 106 may be, for example, a keyway or keyways in an inner surface 132 thereof that receives the key 128, thereby interlocking the sleeves 104 and 106. Alternatively, the keys 128 may be provided on the outer sleeve 106 and the keyways 130 on the inner sleeve 104. In a preferred embodiment, each key 128 and each keyway 130 is sized to provide a controlled distance of rotation between the inner and outer sleeves 104 and 106. For example, each keyway 130 may have a width $W_1$ that is larger than the width $W_2$ of each key 128, such that each key 128 is movable a certain distance circumferentially from one side of the respective keyway 130 to the other. That circumferential distance moveable by the key 128 in the keyway 130 (or the difference between $W_1$ and $W_2$) defines the controlled distance of rotation between the inner and outer sleeves 104 and 106. Outer sleeve 106 may include an outer gripping surface 134 to facilitate gripping and rotation of outer sleeve 106.

Figure 3:
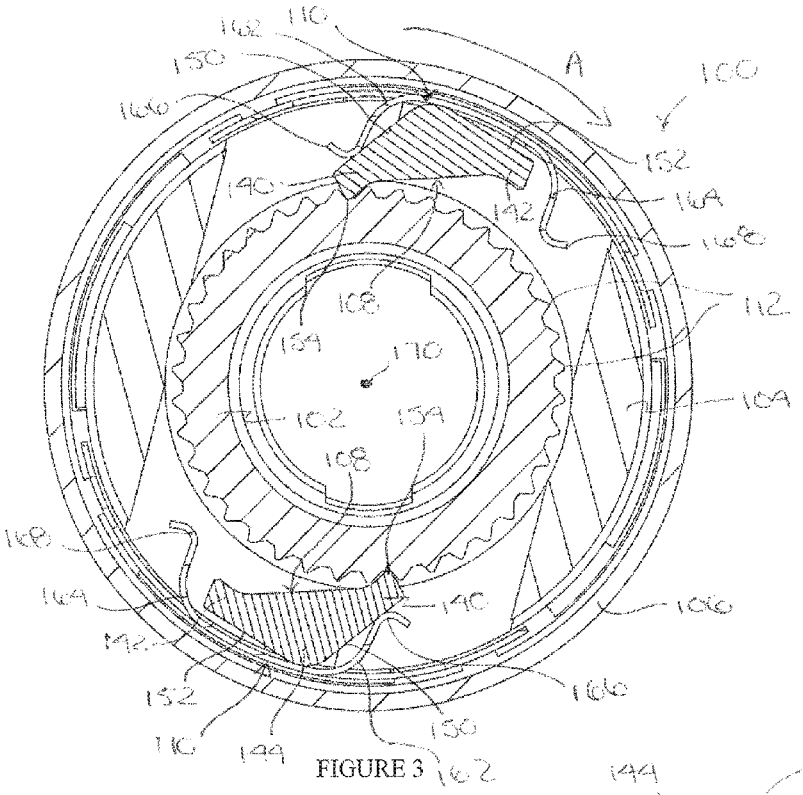
FIG. 3 is a cross-sectional view of the connector coupling illustrated in FIG. 1 taken along the transverse axis of the connector coupling.
Figure 6:
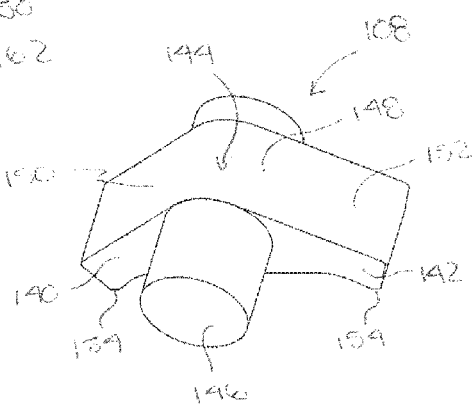
FIG. 6 is a perspective view of a pawl of the connector coupling illustrated in FIG. 1.
Figure 7:
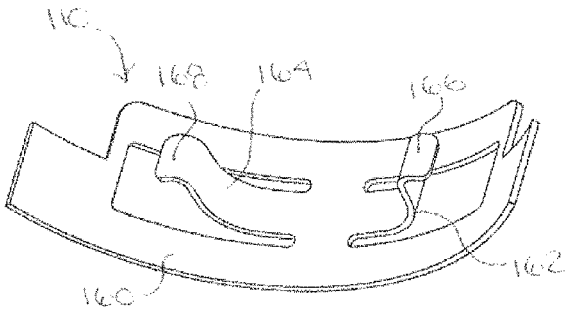
FIG. 7 is a perspective view of a spring member of the connector coupling illustrated in FIG. 1.

Each of the one or more self-locking pawls 108 is received in a respective cavity 122 of inner sleeve 104 and is adapted to engage the ratchet teeth 112 of connector body 102, as seen in FIG. 3. Each pawl 108 includes opposite first and second ends 140 and 142 and an apex portion 144, therebetween, as seen in FIG. 6. A pivot pin 146 extends through apex portion 144 that allows the pawl 108 to toggle between a first position (e.g. when first end 140 engages ratchet teeth 112) and a second position (e.g. when second end 142 engages ratchet teeth 112). The pivot pin 146 sits in cutout 124 of the respective cavity 122. Each pawl 108 may have first and second working surface portions 150 and 152 on an outer surface 148 thereof for engaging one of the spring members 110 in the first and second positions, respectively. Each of the first and second ends 140 and 142 of the pawl 108 preferably includes a lip 154 shaped to positively engage the ratchet teeth 112.

Each of the one or more spring members 110 is attached to the inner surface 132 of outer sleeve 106, as seen in FIG. 3, and positioned to bias each pawl 108 into engagement with the ratchet teeth 112. Each spring member 110 preferably includes a fixed base 160 that may be curved to match that of the outer sleeve's inner surface 132. First and second springs arms 162 and 164 extend from the fixed base 160. A tail end 166 of the first spring arm 162 engages first working surface portion 150 of pawl 108 when pawl 108 is in the first position (FIG. 3) and a tail end 168 of the second spring arm 164 engages second working surface portion 152 when pawl 108 is in the second position. The tail ends 166 and 168 may have a generally L-shape.

When mating connector coupling 100 to a mating connector, inner and outer sleeves 104 and 106 are rotated together in a mating direction with respect to a longitudinal axis 170 of the connector body 102 (arrow A in FIG. 3) such that the one or more pawls 108 engage the ratchet teeth 112 in a first position wherein each pawl 108 may ratchet over the teeth 112 in the mating direction while preventing rotation of the inner and outer sleeves in an unmating direction opposite the mating direction. When in the first position, first arm 162 of each spring member 160 pushes on first working surface portion 150 of each pawl 108, thereby biasing the first end 140 of each pawl 108 into engagement with ratchet teeth 112 while also allowing the first end 140 of each pawl 108 to ratchet over the teeth 112 when the coupling 100 is rotated in the mating direction. If inner and outer sleeves 104 and 106 are rotated in the unmating direction with respect to the connector body 102, such as due to vibration, the second working surface portion 152 of each pawl 108 will abut the fixed base 160 of the spring member 110 and/or the inner surface 132 of the outer sleeve 106 such that the first end 140 of each pawl 108 cannot disengage from ratchet teeth 112, thereby self-locking the coupling 100. Thus, once inner and outer sleeves 104 and 106 are rotated together in the mating direction and the internal threads 120 of the connector body 102 engage the mating connector, the coupling 100 is prevented from loosening in the unmating direction by the self-locking pawls 108.

To release the coupling 100 from engagement with a mating connector, outer sleeve 106 is rotated with respect to inner sleeve 104 for the controlled distance, thereby moving each spring member 110 fixed to outer sleeve 106 the controlled distance to toggle each pawl 108 from the first position to the second position. The first ends 140 of pawls 108 are released from engagement with teeth 112 and moved to the second position in which the second ends 142 of each pawl 108 engage with ratchet teeth 112. The second spring arm 164 pushes on second working surface portion 152 of each pawl 108 to bias each pawl into engagement with teeth 112 in the second position. That allows inner and outer sleeves 104 and 106 to rotate together in the unmating direction to release the internal threads 120 of connector body 102 from the mating connector. Like in the first position, each pawl 108 is allowed to ratchet over ratchet teeth 112 as the sleeves 104 and 106 are rotated in the unmated direction.

Once in the second position, the one or more pawls 108 self-lock to prevent rotation of sleeves 104 and 106 in the mating direction (opposite the unmating direction). If the outer sleeve 106 is rotated in the mating direction when the pawls 108 are in the second position, first working surface portions 150 of each pawl 108 will abut the fixed base 160 of the spring member 110 and/or the inner surface 132 of the outer sleeve 106 such that the second end 142 of each pawl 108 cannot disengage from ratchet teeth 112. This prevents separation of the coupling's components, particularly outer sleeve 108, which could otherwise be separated (such as by being rotated off the coupling) and lost from the coupling 100.

While particular embodiments have been chosen to illustrate the invention, it will be understood by those skilled in the art that various changes and modifications can be made therein without departing from the scope of the invention as defined in the appended claims.

What is claimed is:

1. A connector coupling, comprising:

a connector body, said connector body having ratchet teeth and defining a longitudinal axis;

an inner sleeve receiving said connector body;

at least one self-locking pawl pivotably coupled to said inner sleeve, said at least one self-locking pawl being configured to toggle between first and second positions in engagement with said ratchet teeth of said connector body;

an outer sleeve surrounding said inner sleeve, said inner and outer sleeves being rotatable together in opposite mating and unmating directions with respect to said longitudinal axis of said connector body; and at least one spring member attached to an inner surface of said outer sleeve, said at least one spring member being configured to bias said at least one self-locking pawl, wherein when said at least one self-locking pawl is in said first position engaging said ratchet teeth, said inner and outer sleeves are rotatable together in said mating direction only and prevented from rotating in said unmating direction and when said at least one self-locking pawl is in said second position engaging said ratchet teeth, said inner and outer sleeves are rotatable together in said unmating direction only and prevented from rotating in said mating direction.

2. The connector coupling of claim 1, wherein said outer sleeve is rotatable with respect to said inner sleeve for a controlled distance to release said at least one self-locking pawl from engagement with said ratchet teeth.

3. The connector coupling of claim 2, wherein said inner and outer sleeves include corresponding alignment members.

4. The connector coupling of claim 3, wherein said alignment member of one of said inner and outer sleeves is at least one key and said alignment member of the other of said inner and outer sleeves is at least one keyway that receives said at least one key, and the controlled distance is defined by a circumferential distance moveable by said key in said keyway.

5. The connector coupling of claim 1, wherein said at least one self-locking pawl has opposite first and second ends and an apex portion therebetween, and a pivot pin extends through said apex portion allowing said at least one self-locking pawl to toggle between said first and second positions.

6. The connector coupling of claim 5, wherein each of said first and second ends has a lip for engaging said ratchet teeth in said first and second positions, respectively.

7. The connector coupling of claim 5, wherein said at least one self-locking pawl includes first and second working surface portions on an outer surface thereof for engaging said at least one spring member.

8. The connector coupling of claim 1, wherein said at least one spring member includes a fixed base attached to said inner surface of said outer sleeve, and first and second springs extending from said fixed base, said first spring arm includes tail end shaped to contact a first end of said at least one self-locking pawl when said at least one self-locking pawl is in said first position, and said second spring arm includes a tail end shaped to contact a second end opposite said first end of said at least one self-locking pawl when said at least one self-locking pawl is in said second position.

9. The connector coupling of claim 1, wherein said inner sleeve including at least one cavity that receives said at least one self-locking pawl, said cavity is sized to allow free toggle movement of said at least one self-locking pawl between said first and second positions.

10. The connector coupling of claim 9, wherein an outer surface of said inner sleeve includes at least one cutout adjacent said cavity, said cutout is adapted to receive a pivot pin of said at least one self-locking pawl.

11. The connector coupling of claim 1, wherein an inner surface of said inner sleeve includes threads for engaging a mating connector.

12. The connector coupling of claim 1, wherein said ratchet teeth form a continuous annular ring around said connector body.

13. A connector coupling, comprising:

a connector body, said connector body having ratchet teeth and defining a longitudinal axis;

an inner sleeve receiving said connector body;

at least one self-locking pawl having opposite first and second ends and an apex portion therebetween, said apex portion having a pivot pin coupled to said inner sleeve allowing said at least one self-locking pawl to toggle between a first position, in which said first end engages said ratchet teeth, and a second position, in which said second end engages said ratchet teeth;

an outer sleeve surrounding said inner sleeve, said inner and outer sleeves being rotatable together in opposite mating and unmating directions with respect to said longitudinal axis of said connector body; and at least one spring member attached to an inner surface of said outer sleeve, said at least one spring member having first and second spring arms configured to bias said at least one self-locking pawl, wherein when said at least one self-locking pawl is in said first position, said first spring arm contacts said first end of said at least one self-locking pawl to bias said at least one self-locking pawl in said first position and said inner and outer sleeves are rotatable together in said mating direction only and prevented from rotating in said unmating direction, and wherein when said at least one self-locking pawl is in said second position, said second spring arm contacts said second end of said at least one self-locking pawl to bias said at least one self-locking pawl in said second position and said inner and outer sleeves are rotatable together in said unmating direction only and prevented from rotating in said mating direction.

14. The connector coupling of claim 13, wherein said outer sleeve is rotatable with respect to said inner sleeve for a controlled distance to release said at least one self-locking pawl from engagement with said ratchet teeth.

15. The connector coupling of claim 14, wherein one of said inner and outer sleeves has at least one key and the other of said inner and outer sleeves has at least one keyway that receives said at least one key, and the controlled distance is defined by a radial distance moveable by said key in said keyway.

16. The connector coupling of claim 13, wherein each of said first and second ends of said at least one self-locking pawl has a lip for engaging said ratchet teeth in said first and second positions, respectively.

17. The connector coupling of claim 13, wherein said at least one self-locking pawl includes first and second working surface portions on an outer surface thereof for engaging said first and second spring arms, respectively.

18. The connector coupling of claim 13, wherein said inner sleeve including a cavity that receives said at least one self-locking pawl, said cavity is sized to allow free toggle movement of said at least one self-locking pawl between said first and second positions; and an outer surface of said inner sleeve includes a cutout adjacent said cavity, said cutout is adapted to receive said pivot pin of said at least one self-locking pawl.

19. A method of coupling a connector coupling to a mating connector, the connector coupling having a connector body received in an inner sleeve and an outer sleeve surrounding the inner sleeve, comprising the steps of:

rotating the outer and inner sleeves together in a mating direction with respect to a longitudinal axis of the connector body and engaging at least one self-locking pawl coupled to the inner sleeve with ratchet teeth of the connector body in a first position preventing rotation of the inner and outer sleeves in an unmating direction opposite the mating direction;

engaging threads of the inner sleeve with a mating connector;

releasing the at least one self-locking pawl from engagement with the ratchet teeth in the first position by rotating the outer sleeve with respect to the inner sleeve for a controlled distance; and rotating the outer and inner sleeves together in the unmating direction and engaging the at least one self-locking pawl with the ratchet teeth in a second position preventing rotation of the inner and outer sleeves in the mating direction.

20. The method of claim 19, further comprising the steps of biasing the at least one self-locking pawl in the first position; and biasing the at least one self-locking pawl in the second position.

21. The method of claim 19, wherein one of the inner and outer sleeves has at least one key and the other of the inner and outer sleeves has at least one keyway that receives the at least one key, and the controlled distance is defined by a circumferential distance moveable by the key in the keyway.

* * * * *